United States Patent [19]

Reba et al.

[11] 4,035,870

[45] July 19, 1977

[54] FIBER DISTRIBUTION AND DEPOSITING APPARATUS

[75] Inventors: Imants Reba, Vancouver, Wash.; Gerald Hugh Hogland, Estacada, Oreg.; Edward Clair Wolthausen, Vancouver, Wash.

[73] Assignee: Crown Zellerbach Corporation, San Francisco, Calif.

[21] Appl. No.: 644,275

[22] Filed: Dec. 24, 1975

[51] Int. Cl.[2] ..... D04H 1/00

[52] U.S. Cl. ..... 19/155; 239/592

[58] Field of Search ..... 19/155, 156–156.4, 19/65 T, 66 T; 239/592, 594, 595, DIG. 7; 222/566–570, 572; 156/62.2, 62.4; 209/3; 29/157 C; 226/97; 302/63; 193/2 R; 51/11; 15/405, 408, 415; 56/32

[56] References Cited

U.S. PATENT DOCUMENTS

| | | | |
|---|---|---|---|
| 1,434,625 | 11/1922 | Olsen | 239/592 X |
| 1,656,549 | 1/1928 | Warmack | 239/592 X |
| 2,035,724 | 3/1936 | Schwartz | 239/592 X |
| 2,537,377 | 1/1951 | Soss | 239/592 X |
| 3,076,236 | 2/1963 | Labino | 19/156.3 |
| 3,101,906 | 8/1963 | Webber | 239/592 |
| 3,396,433 | 8/1968 | Roxlo | 19/156.3 |
| 3,713,590 | 1/1973 | Dorschner et al. | 19/65 T X |

*Primary Examiner*—Dorsey Newton
*Attorney, Agent, or Firm*—Thomas R. Lampe

[57] ABSTRACT

A fiber distribution and depositing apparatus including a forming bell including front and back walls converging and convexly curved in the direction of flow, and side walls connected to the front and back walls to define an open-endedpassageway for fluid-entrained fibers leading from an inlet to an outlet end, said side walls diverging along straight lines in the direction of flow, the cross-sectional area of the passageway along the length thereof remaining substantially constant. The forming bell is disposed between a fiber transport means for directing gaseously-entrained fibers into the bell former inlet at a high velocity and a forming surface positioned adjacent to the outlet of the forming bell and movable along a predetermined direction of movement for receiving the fibers passing through the forming bell passageway.

8 Claims, 13 Drawing Figures

FIBER DISTRIBUTION AND DEPOSITING APPARATUS

BACKGROUND OF THE INVENTION

The present invention relates to a system for distributing and depositing fibrous material to form a web of fibers which is subsequently bonded together by any known expedient such as application of a bonding agent, mechanical force, heat, etc. to form a integral web.

The present invention is concerned with the dry formation of webs, such as webs of wood fibers, plastic fibers or the like, as opposed to conventional wet formation of webs. One of the problems encountered in dry formation of webs is uniform deposition of the fibers preparatory to bonding thereof wherein it is desired that the fibers be deposited in a uniform and continuous manner upon a suitable forming surface such as a moving foraminous wire or cylinder. It is conventional to use forming bells to distribute dry-formed fibers onto a web; however, prior bell former arrangements have not been totally satisfactory, especially in situations wherein the bell former is to perform a spreading function on the fibers passing therethrough; that is, those situations wherein fibers are delivered to the forming bell inlet from a relatively small source such as a small diameter conduit and are to be distributed by the forming bell to a forming surface having an operational width substantially exceeding that of the forming bell inlet. It is often desirable to utilize such a system since small fiber delivery conduits have many economic and operating advantages. For example, the conduits can deliver fibers from a relatively remote fiber supply system, multiple forming stations can be readily accommodated in a limited area, etc. Unfortunately, however, such prior art systems have the disadvantage of being unable to lay down a fiber web having a consistently uniform basic weight in the cross-machine direction.

It is therefore an object of the present invention to provide an improved fiber distribution and depositing apparatus including a forming bell of novel construction which is utilized to deposit a fibrous web having a uniform basis weight onto a forming surface, such as a wire, despite the fact that the inlet end of the forming bell is substantially smaller widthwise than the width of the forming surface and is thus able to receive and distribute fibers from a relatively small conduit. The present system provides for entrainment of ambient air into the bell former along with gaseously-entrained fibers entering same from the conduit to promote fiber separation and provide sufficient dilution so that the fibers do not coalesce. In addition, the precise physical characteristics of the bell former, as will be hereinafter described in greater detail, promote a uniform spreading of the fibers across the forming surface width prior to deposition of the fibers thereon.

SUMMARY

According to the present invention a fiber transport means is provided for transporting gaseously-entrained fibers and includes a conduit having an outlet through which the gaseously-entrained fibers are adapted to be ejected from the conduit at a high velocity. A preferred form of transport means is disclosed in U.S. Pat. No. 3,859,205, issued to Reba et al., on Jan. 7, 1975, and such patent is incorporated by reference into the present application.

A forming bell is fixedly positioned coaxially relative to the fiber transport means and is adapted to receive the gaseously-entrained fibers therefrom. The forming bell includes front and back walls converging and convexly curved in the direction of fiber flow and side walls connected to the front and back walls to define a passageway for the gaseously-entrained fibers from an inlet end to an outlet end defined by the walls, said side walls diverging along straight lines in the direction of fiber flow. The cross-sectional area of the passageway remains substantially constant along the length thereof. The forming bell inlet is spaced from the fiber transport conduit outlet so that a gap is formed therebetween through which ambient air is entrained into the passageway. Means defining a web-forming surface, such as a foraminous forming wire, is positioned adjacent to the outlet of the forming bell and is movable along a predetermined direction of movement and adapted to receive the fibers passing through the forming bell passageway. The cross-machine dimension of the forming bell outlet substantially exceeds the corresponding dimension of the forming bell inlet.

BRIEF DESCRIPTION OF THE DRAWINGS

An embodiment of the present invention is illustrated in the accompanying drawings in which.

GENERAL DESCRIPTION

Figure 1:
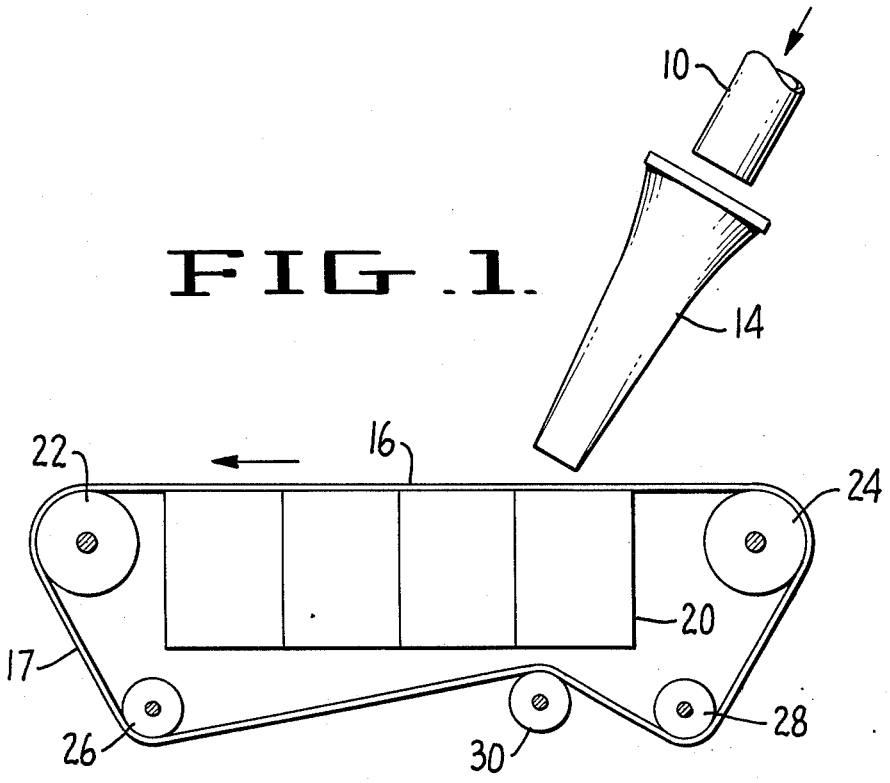
FIG. 1 is a diagrammatic overall side view of the fiber distribution and depositing apparatus of the present invention.
Figure 2:
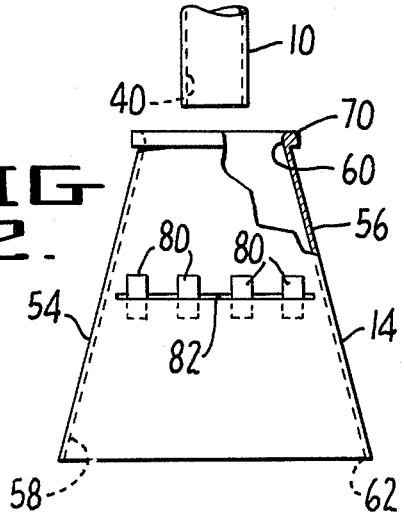
FIG. 2 is a frontal view of the fiber transport conduit in operative association with the forming bell of the present invention and showing a portion of the forming bell partially broken away.
Figure 3:
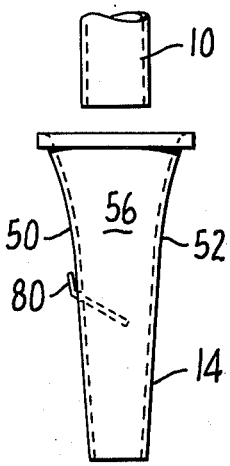
FIG. 3 is a side view of the components illustrated in FIG. 2.

Referring now to FIG. 1 the fiber distribution and depositing apparatus of the present invention is illustrated and comprises a fiber transport means conduit 10, a forming bell 14 fixedly positioned coaxially relative to the fiber transport means conduit and adapted to receive gaseously-entrained fibers issuing therefrom, and means defining a forming surface 16 positioned adjacent to the outlet of the forming bell and movable along a predetermined direction of movement and adapted to receive the fibers passing through the forming bell. Any suitable mounting means (not shown) may be employed to maintain the relative positions of the fiber transport means conduit 10 and the forming bell 14, and as may clearly be seen with reference to FIG. 1, the axis along which conduit 10 and forming bell 14 are aligned is disposed at an angle relative to the web-forming surface 16 which in the embodiment illustrated is the top surface of a continuous foraminous wire 17 of any desired construction disposed over a vacuum table 20 and movable relative thereto by suitable drive means (not shown) which serves to rotate one or more of rollers 22 and 24 about which the foraminous wire 17 travels. The wire is of course continuous and is also journaled about two rollers 26 and 28 so that it forms a run under vacuum table 20. A tension roller 30 may be employed to apply suitable tension to wire 16. It is to be understood that the wire, vacuum table and roller configuration described in this paragraph are per se old in the art. In addition, it is to be understood that the member defining a web-forming surface employed in this invention need not be in the form of a wire but may, for example, be in the form of a foraminous vacuum cylinder, etc.

Figure 4:
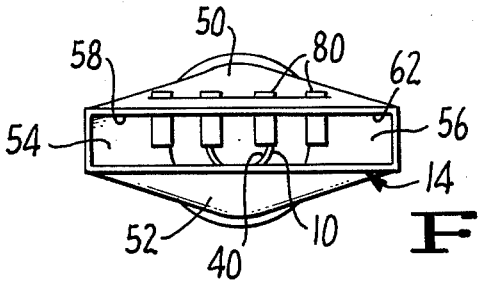
FIG. 4 is a view of the forming bell of the present invention as seen from the outlet end thereof.
Figure 5A:
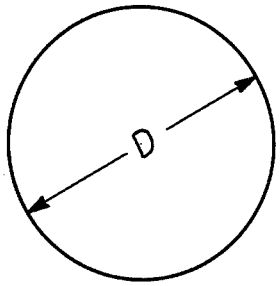
FIGS. 5A–5D are diagrammatic views showing an alternative form of forming bell with FIGS. 5A and 5C showing respectively the inlet and outlet ends thereof and FIGS. 5B and 5D showing respectively frontal and side views thereof.
Figure 5B:
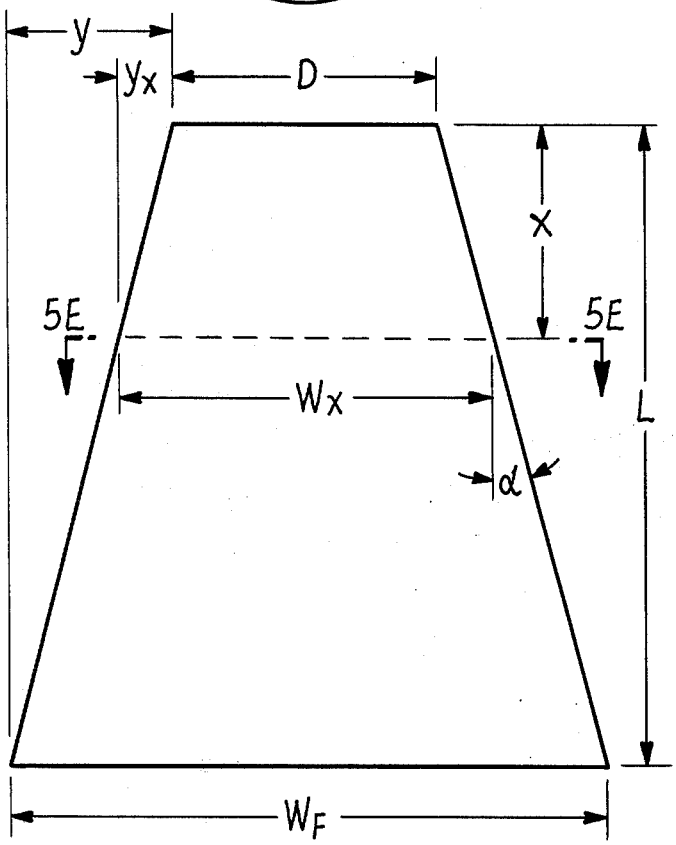
Figure 5D:
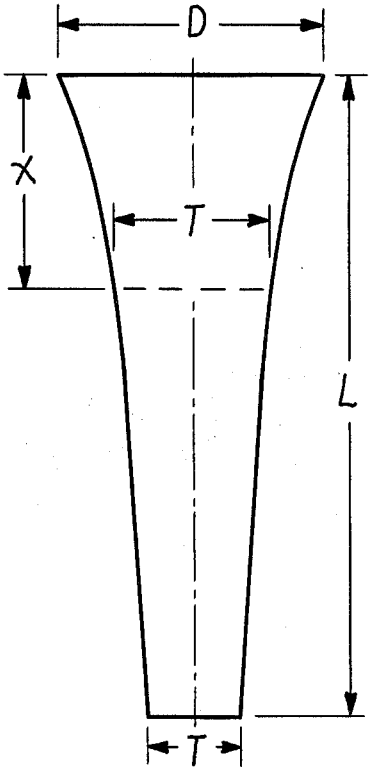
Figure 5C:
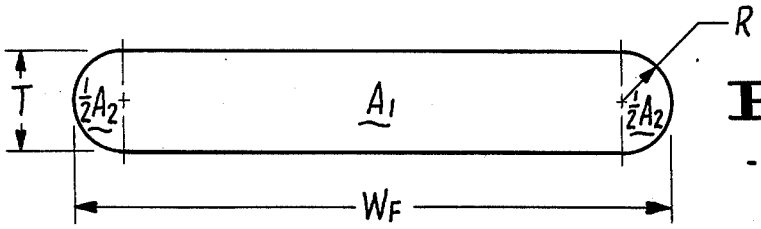
Figure 5E:
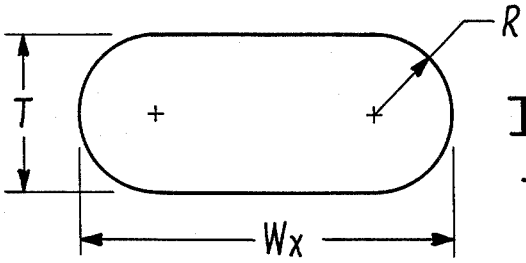
FIG. 5E is a cross-sectional view taken along line 5E–5E in FIG. 5B.

Referring now to the fiber transport means conduit 10, it will be appreciated that this element is operatively associated with any suitable structure which provides a rapidly moving flow of fibrous materials substantially separated and entrained in a gaseous medium which causes said gaseously-entrained fibers to be ejected from the conduit 10 at a high velocity. By the term "high velocity" it is meant any velocity exceeding 1000 feet per minute. A preferred form of structure for delivering gaseously-entrained fibers and causing same to exit conduit 10 at a desired speed is the apparatus shown in U.S. Pat. No. 3,859,205, issued Jan. 7, 1975, to Reba et al. Since reference may be had to that patent for the precise form of apparatus preferred, it will not be described in detail nor illustrated here. Suffice it to say, however, that conduit 10 corresponds to shroud 20 illustrated in that patent with the fibers issuing from conduit 10 corresponding to the first fraction of particles referred to in columns 2, 3 and 4 of the patent that are entrained by a gas issuing from slit 16 disclosed therein so that they flow along external nozzle surface 18 in second flow path 21. The device of U.S. Pat. No. 3,859,205 is modified only to the extent that the collector 22 disclosed therein is not employed and the fibers passing in the direction of the arrows in second flow path 21 continue in the direction of the arrows and exit from shroud 20 and enter the forming bell inlet as will hereinafter be described. As stated above, however, any suitable means for propelling gaseously-entrained and substantially separated particles from conduit 10 may be utilized in the practice of this invention. As may best be seen with reference to FIG. 4, the outlet 40 of conduit 10 has a circular configuration having a diameter *d.*

Disposed coaxially with conduit 10 is forming bell 14 which is adapted to receive gaseously-entrained fibers ejected from the conduit 10 at a high velocity. The forming bell includes front and back walls 50, 52, respectively, which are convexly curved and converge in the direction of fiber flow, and side walls 54 and 56 connected to the front and back walls 50 and 52 to define a passageway 58 for the gaseously-entrained fibers. Side walls 54 and 56 diverge along straight lines in the direction of fiber flow. In the FIGS. 1–4 embodiment side walls 54 and 56 are also planar at the lowermost extent thereof; however this is not essential. For example, the side walls could be partially or completely rounded over their whole length. The passageway has an inlet end 60 and an outlet end 62. The inlet end 60 has a circular configuration having a diameter D and the outlet end is of a substantially rectangular configuration which is adapted to extend across the width of wire 16.

An important aspect of this invention resides in the fact that the cross-sectional area of passageway 58 remains substantially constant along the length thereof as it proceeds from the inlet end 60 to the outlet end 62. By the term "substantially constant" it is meant that the passageway cross-sectional area does not deviate by more than 20%, and preferably not by more than 10%, in area along the length thereof.

Another desirable characteristic of the present invention resides in the fact that the forming bell inlet 60 has an area between about 1.1 and about 2.5 times larger than the area of the fiber transport means outlet 40. Further, it should be noted that the conduit outlet 40 is also spaced axially from the inlet end 60 of the bell former so that a gap is defined therebetween. The purpose of this gap is to allow for entrainment of ambient air into the bell former passageway 58 by the high velocity flow of the gaseously-entrained fibers exiting from conduit outlet 40 and entering into the bell former inlet end 60.

Also contributing to the ability of the disclosed fiber distribution and depositing apparatus to lay down a web of fibers having a substantially uniform basis weight is the fact that the acute angle $\alpha$ formed between each side wall 54 and 56 and the longitudinal axis of the forming bell does not exceed 22°, and preferably is in the order of about 10° to about 15°. Further, in the preferred form of apparatus the cross-machine direction or width of the substantially rectangular outlet 62 of the forming bell is between about 1.5 to about 7 times the diameter of the fiber transport means conduit outlet 40.

The apparatus operates as follows. Gaseously-entrained fibers are ejected at a high velocity out of conduit end 40 so that the gaseously-entrained fibers enter bell former inlet end 60. This causes ambient air flow to be induced through the gap formed between the conduit 10 and bell former 14 which becomes intimately mixed with the entrained fibers upon entry into the bell former passageway 58. To assist in smoothing out the flow of the induced ambient air it is desirable to provide a bell mouth 70 at the bell former inlet end. The bell mouth 70 is of circular configuration and provides an outer annular smooth flow surface 74.

As previously stated, the purpose of the forming bell is to spread fibers in a cross-machine direction in as uniform a manner as possible to provide a fibrous web wherein the amount of fibers per given unit area remain substantially constant. It has been found that this uniformity is optimized by maintaining the angle of divergence $\alpha$ formed between each diverging straight side walls 54 and 56 and the major axis of the forming bell to a value not exceeding 22°, and preferably in the order of about 10° to about 15°. Above the 22° value, severe flow separation from the side walls can take place, causing fiber lay-down nonuniformities.

After the fiber flow has spread in a generally uniform manner by virtue of its passage through the bell former 14, the fibers and gas are propelled from the bell former outlet end 62 onto the forming surface 16 of wire 17. It is preferred that the fiber transport means conduit 10 and the forming bell 14 be positioned coaxially along an axis disposed at an acute angle relative to the forming surface 16 of wire 17 so that the fibers exiting from the forming bell outlet 62 are deposited onto the wire in a direction having a vector component coinciding with the direction of movement of the forming surface. In FIG. 1 the direction of the forming surface 16 is indicated by the arrow. This arrangement lessens the possibility for disturbance of the fibers on the forming wire after they have been deposited thereon since the gas which carries the fibers moves in the same direction as the forming surface.

Finally, it is desirable to provide the forming bell with auxiliary means which may be manipulated by the operator to eliminate any streaking that may still occur in the deposited web in a cross-machine direction due to any thickness variances that still remain. In the disclosed embodiment this means comprises a plurality of vanes 80 which are formed of sheet metal or the like so that they have flat surfaces. Vanes 80 are adapted to be inserted into an elongated slit 82 formed in bell former front wall 50. As shown most clearly in FIG. 3, the vanes are bent upwardly at the ends thereof so that the vanes are retained in position in the slit with the flat surfaces thereof facing the flow of gaseously-entrained fibers through the passageway 58. The vanes may be slid sideways in slit 82 to position them as desired and of course any number of vanes, or none, may be employed in association with the bell former as necessary. The vanes may be utilized to eliminate any streaking occurring in the web being formed by the bell former. The vanes do not stir the flow but produce wakes within the fiber flow which appear as light areas in the web. Thus, a heavy streak can be eliminated by putting a wake-producing vane at the proper crosswise position within the bell former. At any crosswise position within the bell former, the intensity of the wake can be controlled by the width or length of the vane. The forward slanting orientation of the vanes makes them self-cleaning and prevents formation of fiber clumps.

Two factors are the primary contributors to fiber distribution problems in systems which spread fibers from a relatively small fiber source such as conduit 10. The first factor is velocity differentials in the fibers being spread. This problem is solved by the above-described novel configuration of the bell former per se which maintains a uniform fiber velocity profile in the cross-machine direction. The second factor is uneven particle distribution as the fibers enter the bell former. While the bell former configuration itself takes care of much of this and in some fiber and disperser conditions completely solves the problem, at high lineal fiber velocities or when peculiar fiber characteristics are found there simply may not be sufficient time for the fibers to completely mix and be dispersed uniformly within the bell former passageway. The vanes described above may be used to promote uniform fiber distribution in the event the forming bell configuration per se is inadequate for solving the problem.

EXAMPLE I

Referring now to FIGS. 5A–5E, a modified form of bell former is illustrated which is defined by front, back and side walls which define a circular opening at the upper ends thereof and terminate at the lower ends thereof to form a generally rectangular opening. The bell former differs from that illustrated in FIGS. 1–4, in that the side walls thereof are rounded to form half circles over the full length thereof although the side walls also diverge along straight lines in the direction of fiber flow.

The bell former of FIGS. 5A–5E was designed as follows. First, the desired cross-sectional area A of the bell former is selected. As previously stated with respect to the description of the bell former of FIGS. 1–4, the area of the forming bell inlet, and thus the area of passageway of the bell former is between about 1.1 and about 2.5 times larger than the outlet area of the fiber dispersing conduit with which the bell former is associated. For purposes of illustration the cross-sectional area A of the disclosed bell former will equal 240 in$^2$.

The angle $\alpha$ must then be selected. This will be determined somewhat by the desired length of the bell, i.e. the greater the angle $\alpha$ the shorter the bell. As previously noted, the angle $\alpha$ should not exceed 22° and is preferably in the order of about 10° to about 15°. For illustration purposes the angle $\alpha$ of the presently described bell former is 15°. The next factor in the design of the bell is the width $W_F$ of the web to be formed. The outlet exit of the bell former will have the same width $W_F$. For illustration purposes $W_F = 40$ inches. Thus A = 240 in$^2$, $\alpha = 15°$ and $W_F = 40$ inches.

Diameter $D$ of the circular bell former inlet is calculated as follows.

$$A = \frac{\pi D^2}{4}$$

$$D = \frac{4}{\pi} A = 1.1284 \sqrt{A}$$

$$D = 1.1284 \sqrt{240}$$

$$= 17\tfrac{1}{2} \text{ inches}$$

The length $L$ of the bell former is calculated as follows.

By definition $$\tan\alpha = \frac{Y}{L}$$

$$L = Y/\tan\alpha$$

$$\text{a) } 2Y = (W_F - D)$$

$$Y = \frac{W_F - D}{2}$$

$$\text{b) } D = 1.1284 \sqrt{A}$$

$$L = \left(\frac{W_F - 1.1284\sqrt{A}}{2}\right)/\tan\alpha$$

$$L = \left(\frac{40 - 17.5}{2}\right)/\tan 15°$$

$$L = 42 \text{ inches}$$

The width W of the bell former at any distance $X$ from the inlet end thereof may be calculated. Assuming $X$ equals 14 inches the width of the bell is calculated as follows.

As seen with reference to FIGS. 5A–5E, the width of the bell at $X$ inches from top is $$W_x = D + 2Y_x$$

$$Y_x = X \times \tan\alpha$$

$$D = 1.1284 \sqrt{A}$$

Therefore $$W_x = 1.1284 \sqrt{A} + 2 \times X \times \tan\alpha$$

Thus, 14 inches from the top the forming bell will be $$W_x = 1.1284\sqrt{240} + 2 \times 14 \times \tan 15° = 25 \text{ inches wide}$$

The thickness of the bell former at any distance $X$ from the top can also be calculated as follows.

Area $(A) = A_1 + A_2 =$ constant a. $A_1 = T \times (W = 2R)$
$= T \times (W = D)$
$= TW - TD\ T = D = 2R$
$= TW - T^2$ b. $A_2 = (\pi D^2/4)$
$= 0.7854D^2\ D = T = 2R$
$= 0.7854T^2$ Therefore $$A = TW - T^2 + 0.7854T^2$$
$$A = TW - 0.2146T^2$$

– Quadratic Equaton $$O = ax^2 + bx + c$$

$$X = \frac{-b \pm \sqrt{b^2 - 4ac}}{2a}$$

$$O = -A - TW - .2146T^2$$

$$T = \frac{-W \pm \sqrt{W^2 - (4 \times -0.2146 \times -A)}}{2 \times -0.2146}$$

Substituting

$$W = 1.1284\sqrt{A} + 2 \times X \times \tan\alpha$$

We get $$T = \frac{(-1.1284\sqrt{A} - 2X\tan\alpha) + [(1.1284\sqrt{A} + 2X\tan\alpha)^2 - 0.8584\sqrt{A}]^{\frac{1}{2}}}{W^2 - (4 \times -0.2146 \times -A) \quad -0.4292}$$

For example, 14 inches from the top of the form the forming bell will be $$T = 10.566 \text{ inches thick}$$

To construct a complete forming bell the values for $A$, $W_F$ and $\alpha$ are selected. Diameter $D$ and length $L$ are then calculated. Finally, the width $W$ and thickness $T$ are calculated at a selected number of distances $X$ along the length of the bell former. These values are then plotted and interpolated to produce the shapes of the bell former walls. The bell former is then fabricated from sheet metal, rigid plastic sheeting or the like.

EXAMPLE II

Referring now to FIGS. 6A–6D, a forming bell having a circular inlet and a rectangular outlet is illustrated. The procedural steps for designing a constant cross-sectional area forming bell of this type are substantially the same as those described with respect to the design of Example I and only those steps that differ will be described hereinafter. Again the assumption will be that A = 240 in², $\alpha = 15°$ and $W_F =$ 40.

$$\text{Length } L = \frac{(W_F - 1.1284\sqrt{A})}{2} / \tan\alpha$$

$$L = 42 \text{ inches}$$

Width $W_x$ at $X$ inches from the top of the bell former is calculated as follows.

$$W_x = 1.1284\sqrt{A} + 2 \times X \times \tan\alpha$$

Example at 7 inches $$W_x = 21.23$$

Figure 6A:
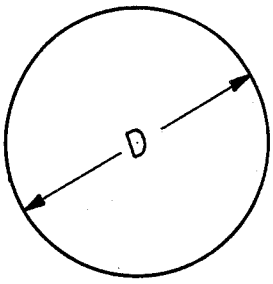
FIGS. 6A–6C are diagrammatic views of a forming bell having a circular inlet and a rectangular outlet with FIGS. 6A and 6C showing respectively the inlet and outlet ends and FIG. 6B showing the frontal view of the bell.
Figure 6B:
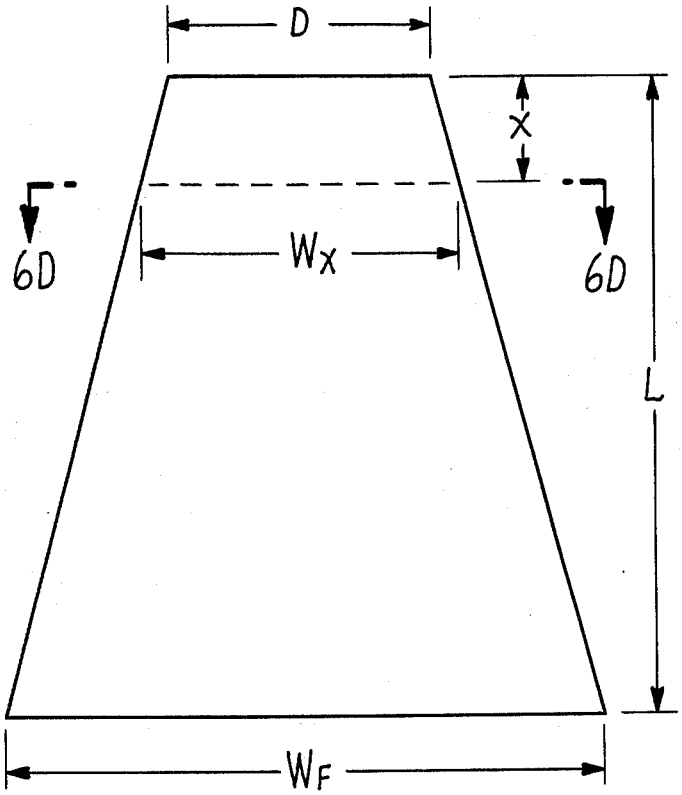
Figure 6C:
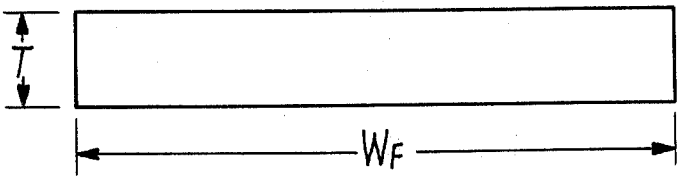
Figure 6D:
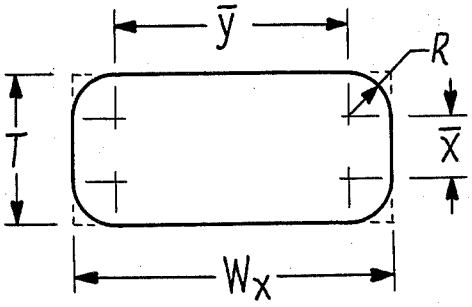
FIG. 6D is a cross-sectional view taken along line 6D–6D of FIG. 6B.

For a certain upper extent of the length of the bell former any cross-section taken therethrough will produce a generally rectangular cross-section with straight wall segments connected at rounded corners. FIG. 6D, for example is a cross-section taken along line 6D–6D in FIG. 6B. This configuration results from the gradual change from a circular configuration to a rectangular configuration. The area A of such a configuration = thickness $T$ times width $W$ less the area bounded by the imaginary dash lines at the corners and the actual rounded corners $A_o$.

$$A_o = (2R \times 2R - \pi R^2)$$
$$= (4R^2 - \pi R^2)$$
$$A = T \times W - (4R^2 - \pi R^2)$$

It is to be noted that when $R = 0$ the passageway becomes rectangular and follows the design rules of $$T = (A/W)$$
$$W = \sqrt{A} \pm 2 \times X \times \tan\alpha$$
$$T = A/\sqrt{A} + 2 \times X \times \tan\alpha$$

It is not possible to linearly reduce the radius from $R = D/2$ at the inlet to $R = 0$ at the bell exit because there will exist sections where $2R$ is greater than $T$ (thickness) which is not possible. Therefore, the fabricator will choose to reduce the radius to zero at some percentage of the total length. For illustration purposes this distance will be 50% of the total length or $L/2$.

For example, with $L$ equal to 42 inches, $R$ will diminish to zero at 21 inches and $R$ will go from the inlet radius of (17.5/2) or 8.75 to zero in 21 inches. In other words the radius R will be reduced by (8.75/21) or 0.4167 inches for every inch from the top of the bell.

The radius at $X$ inches from the top of the bell former is expressed by the operation $$R = D/2 - [(D/2/0.5L) \times X]$$

For example at $X = 14$ inches, $L = 42$ inches and $D = 17.5$ inches, $R = 2.92$ inches.

After calculating $R$ the thickness $T$ of a section similar to that illustrated in FIG. 6D may be calculated. We know that Thus, $$A = T \times W - (4R^2 - \pi R^2)$$

$$T = \frac{A + (4R^2 - \pi R^2)}{W}$$

$$W = 1.1284\sqrt{A} + 2 \times X \times \tan\alpha$$

Therefore, $$T = \frac{A + (4R^2 - \pi R^2)}{1.1284\sqrt{A} + 2 \times X \times \tan\alpha}$$

for the top half of the bell former. For the lower half of the bell former, we use the previously described equation $$T = A/\sqrt{A} + 2 \times X \times \tan\alpha$$

As with the bell former of Example I, the bell former of Example II may be fabricated after the values of a preselected number of cross-sections are calculated, plotted and interpolated.

We claim:

1. Particulate fiber distribution and depositing apparatus comprising, in combination:

a. fiber transport means for transporting gaseously-entrained fibers and including a conduit having an outlet through which said gaseously-entrained fibers are adapted to be ejected from the conduit at a high velocity;

b. a forming bell adapted to receive said gaseously-entrained fibers from said fiber transport means conduit outlet and spread said fibers in a cross-machine direction, said forming bell including front and back walls the inner surfaces thereof uniformly converging and convexly curved in the direction of fiber flow along substantially the full extent of the length thereof and side walls connected to said front and back walls to define a passageway for said gaseously-entrained fibers from an inlet end defined by said walls to a substantially rectangular outlet end defined by said walls, said side walls diverging along straight lines in the direction of fiber flow, the cross-sectional area of said passageway remaining substantially constant along the length thereof, said forming bell inlet being spaced from said fiber transport means conduit outlet so that a gap is formed therebetween through which ambient air is entrained into said passageway; and c. means defining a web-forming surface positioned adjacent to the outlet of said forming bell movable along a predetermined direction of movement and adapted to receive the fibers passing through said forming bell passageway after the fibers have been spread in a cross-machine direction by said forming bell.

2. The apparatus of claim 1 wherein said fiber transport means conduit and said forming bell are positioned coaxially along an axis disposed at an acute angle relative to said web-forming surface so that the fibers exiting from the forming bell outlet are deposited onto the web-forming surface in a direction having a vector component coinciding with the direction of movement of said web-forming surface.

3. The apparatus of claim 1 wherein said fiber transport means outlet and said forming bell inlet end have a substantially circular configuration and said forming bell inlet area is about 1.1 to about 2.5 times larger than the exit area of said fiber transport means outlet.

4. The apparatus of claim 1 wherein said fiber transport means outlet and said forming bell inlet end have a substantially circular configuration and the width of said substantially rectangular outlet is between about 1.5 to about 7 times the diameter of said fiber transport means outlet.

5. The apparatus of claim 3 wherein the angle of divergence formed between each side wall and said axis does not exceed 22°.

6. The apparatus of claim 1 further comprising means disposed in said passageway for inducing wakes in the fiber flow passing therethrough.

7. The apparatus of claim 6 wherein said wake-inducing means comprises at least one elongated vane having a substantially flat surface selectively fixedly positioned in said passageway so that the fiber flow impinges on said substantially flat surface.

8. A forming bell for depositing fluid-entrained particulate fibers onto a forming surface comprising: front and back walls and side walls connected to said front and back walls to define an open-ended passageway for fluid-entrained fibers leading from an inlet end to a substantially rectangular outlet end, the inner surfaces of said front and back walls uniformly converging and being convexly curved in the direction of fiber flow along substantially the full extent of the length thereof and said side walls diverging along straight lines in the direction of fiber flow, at least one elongated wake-inducing vane having a substantially flat surface selectively fixedly positioned in said passageway so that fiber flow passing through said passageway impinges on said substantially flat surface.

* * * * *